United States Patent [19]

Muckelrath

[11] 4,334,862

[45] Jun. 15, 1982

[54] BARREL WARMER FOR DRILLING RIGS

[75] Inventor: Ernest R. Muckelrath, Tioga, N. Dak.

[73] Assignee: Tioga Air Heaters, Inc., Tioga, N. Dak.

[21] Appl. No.: 182,395

[22] Filed: Aug. 26, 1980

[51] Int. Cl.[3] ..... F27B 9/02; E01C 19/45

[52] U.S. Cl. ..... 432/128; 126/343.5 A; 432/120; 432/226

[58] Field of Search ..... 432/120, 226, 128; 126/343.5 A

[56] References Cited

U.S. PATENT DOCUMENTS 2,708,042 5/1955 McCallum ..... 126/343.5 A
3,786,800 1/1974 Heller ..... 126/343.5 A
4,237,857 12/1980 Sharp, Sr. ..... 126/343.5 A

FOREIGN PATENT DOCUMENTS 931844 8/1973 Canada ..... 126/343.5

*Primary Examiner*—John J. Camby
*Attorney, Agent, or Firm*—Harvey B. Jacobson

[57] ABSTRACT

A warming device is constructed to enclose barrels filled with lubricating oil for the purpose of maintaining the oil at operating viscosities even when ambient temperature conditions are severely cold. The barrel warming device includes a housing for supporting a plurality of barrels, a heating device placed on the housing for providing heat to the housing and the barrels, a movable hoist able to place or remove the barrels into or from the housing, and a skid which supports the housing and enables the easy transportation of the barrels. The barrel warming device has particular utility for storing various weights of lubricating oil needed by oil drilling rigs which are operated in cold climates.

10 Claims, 3 Drawing Figures

BARREL WARMER FOR DRILLING RIGS

BACKGROUND OF THE INVENTION

Field of the Invention

This invention relates to a barrel warming device for maintaining lubricating oil used in the operation of oil rigs in cold climates at the proper operating viscosity. In particular, the barrel warming device of the present invention comprises a housing for holding a plurality of barrels containing various weights of oil in which the housing is supported on an easily transportable skid and includes a heating means secured thereto for providing warm air therein, thus, maintaining the oil contained in the barrels at the proper operating viscosities. The barrel warmer also includes a movable hoist for moving the barrels into and out of the enclosed housing.

In order for drilling rigs such as those used to produce oil to operate efficiently, substantial amounts of lubricating oil of various weights must be added to the drilling machinery. To supply the appropriate amounts of each weight of oil to the drilling site oftentimes requires that the oil barrels be handled and transported several times. Accordingly, the risk of damage to the barrel increases each time the barrel is transported or loaded and unloaded from one area to another. Further, the climates in various highly productive oil-producing areas such as the northern slope of Alaska and northern plains of the United States can be quite severe, providing temperatures of −30° or −40° F. At such cold temperatures, the viscosity of the lubricating oil can change and render the oil unusable for its intended purpose. Also, working conditions in these extremely cold climates are harsh and any extra work such as moving filled or empty barrels to and from a storage supply can become a cumbersome task. Since the increased production of domestic oil is a major feature in national plans to reduce dependence on imported foreign oil, it is essential that the operation of finding and producing oil from domestic oil fields be as efficient as possible.

Accordingly, there is a need for providing a means by which a plurality of oil barrels can be transported to a drilling site without excessive handling of the individual barrels during transport and storage with the consequent risk of the barrels being bent or damaged. Further, a need exists for providing oil rigs operating in extremely cold climates with the proper weights of lubricating oil which can be stored at the drilling site and be maintained at the proper viscosity even at extremely cold temperatures.

SUMMARY OF THE INVENTION

An object of the present invention is to provide a device which will hold and store a plurality of oil barrels and maintain the oil contained therein at the proper operating viscosity.

Another object of the present invention is to provide a device for holding and storing a plurality of oil barrels and maintaining the oil contained therein at the proper operating viscosity by heating the area in which the oil barrels are stored.

Another object of the present invention is to provide a device for storing and supporting a plurality of oil barrels which will enable the easy transportation of the barrels to and from a working site reducing the handling of the barrels and subsequent chance of damaging the barrels.

Still another object of the present invention is to provide a barrel warming device which can support a plurality of barrels, which is easily transportable to a working site and which provides a means for moving the barrels into and out of a warmed housing.

In accordance with the present invention, the above objects are provided by a barrel warming device which includes an enclosed housing containing a plurality of compartments for supporting barrels in which the housing is supported on an easily transportable skid. A warm air inlet is provided in the housing which includes an attached heating device for supplying warm air therein. Placed on the housing is a movable hoist which can lift individual barrels to and from individual compartments placed within the housing.

The device of the present invention has particular utility for storing a supply of lubricating oil of various weights for oil drilling rigs and enables the oil contained within the barrels to be warmed and thus maintained at the proper operating viscosity even at extremely cold temperatures. The individual compartments contained within the housing can hold all the required weights of oil that are needed to operate the drilling machinery. The skid which supports the housing enables all the necessary oil barrels to be handled and transported to the drilling site at one time eliminating the necessiy of handling the individual barrels many times between storage and the drilling site and the consequent hazard of the barrels being bent or damaged which can prevent the owner from receiving a full return on the barrels.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
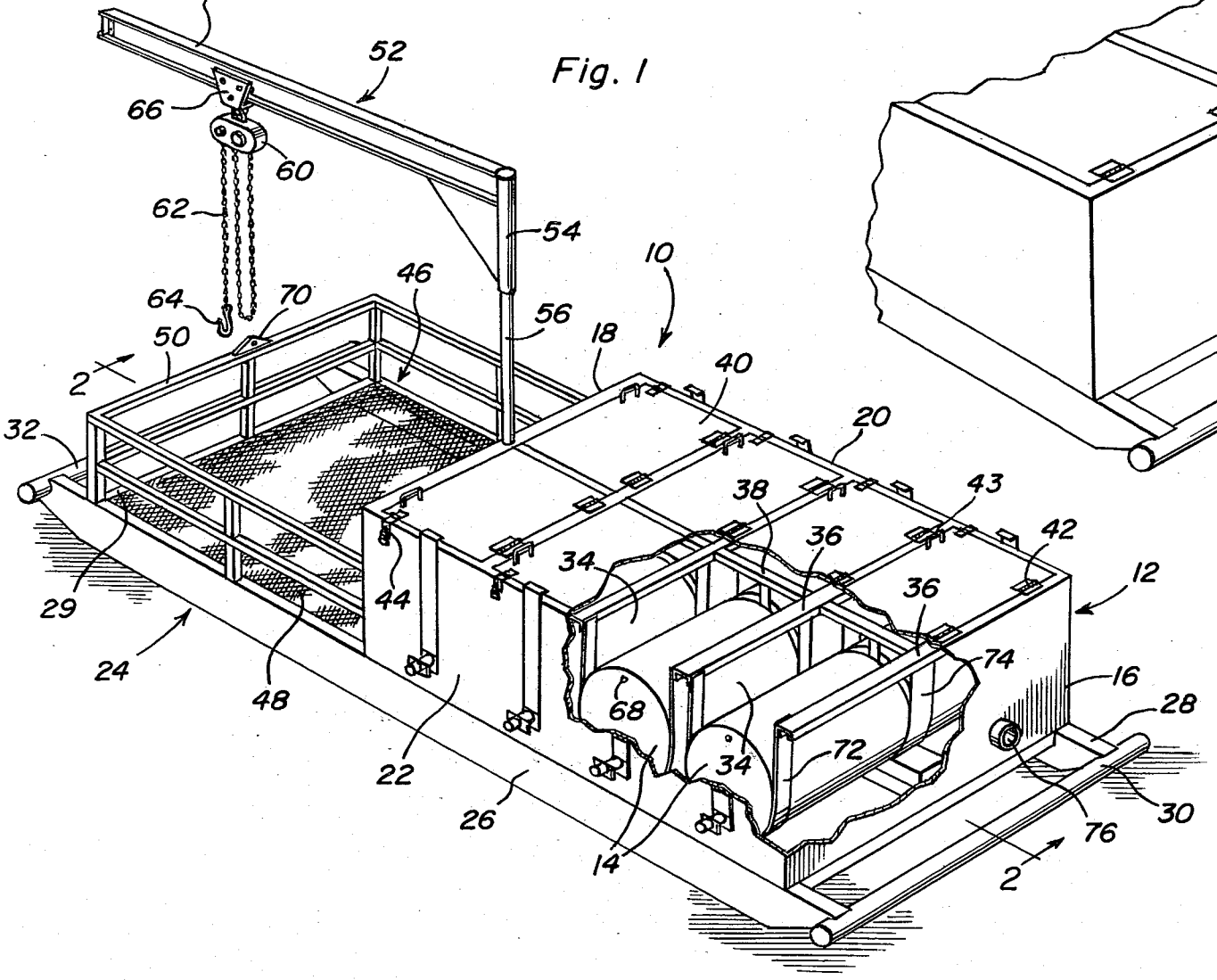
FIG. 1 is a perspective view of the barrel warming device of the present invention with a portion of the housing cut away to illustrate the placement of the barrels within the individual compartments of the housing.

The barrel warming device of the present invention is generally indicated by reference numeral 10 in FIG. 1. Barrel warming device 10 includes a housing 12 for enclosing a plurality of barrels 14 which contain a quantity of oil therein. Housing 12 may be covered or lined with a layer of thermal insulation. Housing 12 is formed from the enclosure of four side walls 16, 18, 20 and 22. Housing 12 is supported on skid 24 comprising runner elements 26 and 28 and pull bars 30 and 32 extending between runner elements 26 and 28 and placed at opposite ends thereof. The placement of housing 12 on skid 24 enables a plurality of barrels to be transported at one time to and from the working site, eliminating the handling of individual barrels to the working site from a separate storage area.

Housing 12 is divided into a plurality of compartments 34. Each compartment 34 can hold a single barrel 14. Compartments 34 are formed and separated from each other by means of a plurality of transverse supports 36 extending between side walls 20 and 22 and a longitudinal support 38 placed across the top of respective end walls 16 and 18 forming the enclosed housing. The top of each compartment 34 is enclosed by a door 40 pivotally mounted on the individual transverse supports 36 by means of a pair of spaced hinges 42 such as conventional roll hinge. Each door 40 includes a handle 43 for moving door 40 in the raised or lowered position. Each door 40 can be locked in the closed position by any type of conventional locking device generally indicated by reference numeral 44. The barrel warming device 10 illustrated in FIG. 1 contains eight compartments 34 although the amount of compartments can vary depending upon the needs of the user. Preferably, the number of bins or compartments 34 are such that the housing 12 can hold enough barrels containing the different weights of oil required to operate the drilling rigs. In such a case, two of the compartments 34 will be for holding each weight of oil, so one barrel for each weight will be full and warm at all times.

Placed along the longitudinal extent of skid 24 is utility space 46 not enclosed by housing 12 but including a screened floor 48 which may extend fully along the longitudinal extent of skid 24. Screened floor 48 may be used to store various pieces of small machinery outside housing 12. Further, utility space 46 increases the capacity of barrel warming device 10 to store empty or filled oil barrels either upright or laying down. Utility space 46 is enclosed by means of railing 50 supported on runner members 26 and 28 and cross support 29. Along with housing 12, railing 50 fully encloses utility space 46 preventing any equipment or oil barrels from rolling or falling off of barrel warming device 10.

Included on barrel warming device 10 is movable hoist 52 which is capable of lifting individual oil barrels 14 to and from compartments 34 or utility space 46. Hoist 52 is long enough to reach barrels 14 when they are loaded on a truck or in compartments 34 for transport of the barrels from device 10 for use adjacent machinery requiring the lubricating oil. Hoist 52 includes support bar 54 which is mounted for 360° rotation about post 56 secured to housing 12 by any means which will firmly hold post 56 in a stable manner. Rotatable support bar 54 supports lifting I beam 58 which in turn supports for movement therealong carriage 60 which contains lifting chain 62 and hook 64. Carriage 60 is supported for movement along lifting I beam 58 by means of movable guide 66. Of course, the exact details of construction of hoist 52 can vary, the illustration providing only a general description of the device. Hook 64 is used to lift barrels 14 from compartments 34 by placement through a catch on the barrel such as indicated by catch 68. Holding device 70 placed on railing 50 may be used to secure hook 64 in place when not in use.

Figure 2:
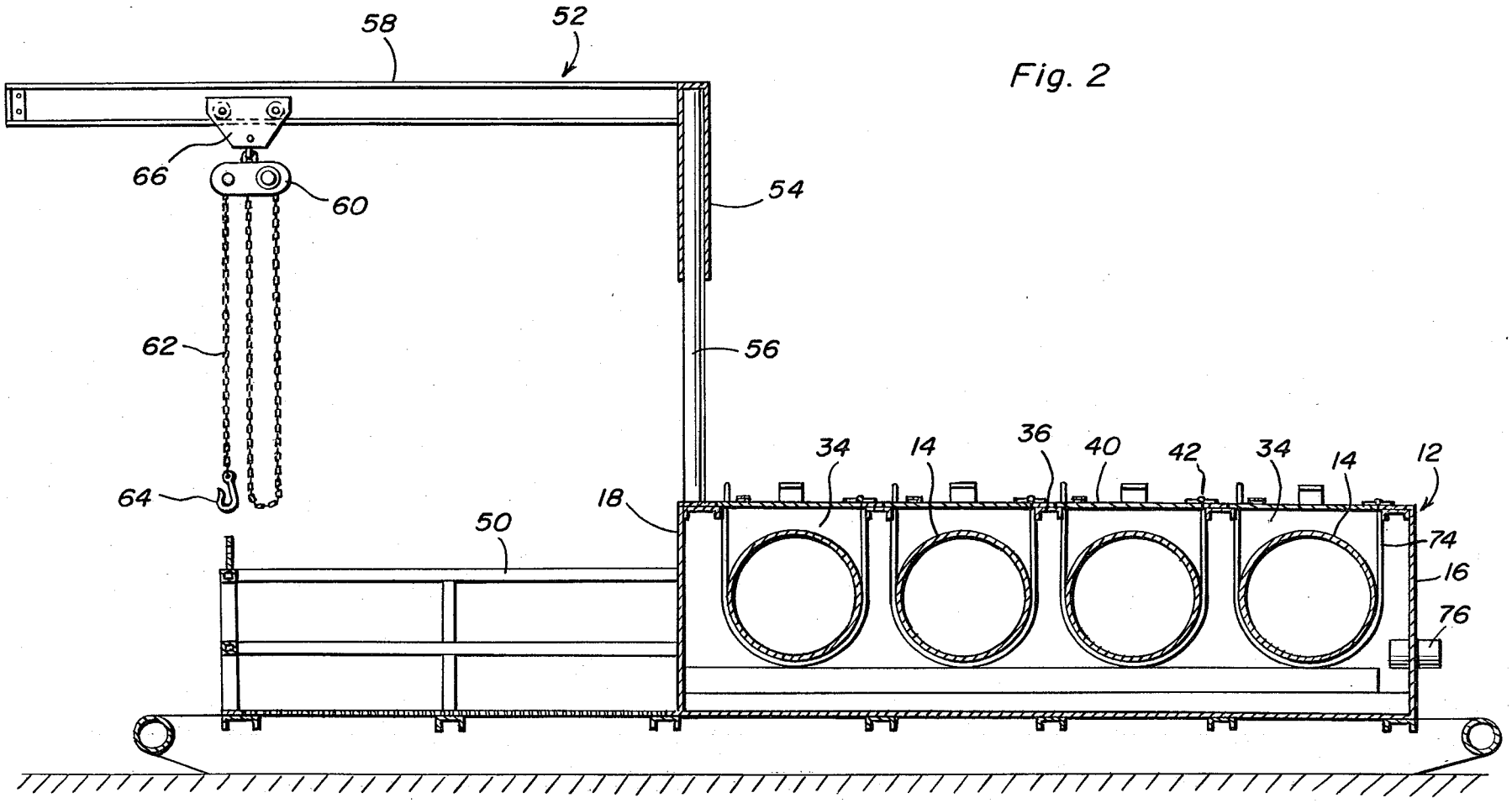
FIG. 2 is a longitudinal sectional view of the barrel warming device taken generally along the line 2—2 of FIG. 1.

Referring to FIGS. 1 and 2, individual barrels 14 are supported in respective compartments 34 by means of a pair of straps 72 and 74 placed between consecutive transverse supports 36 and spaced to contact each end of a barrel 14. Straps 72 and 74 can be attached to transverse supports 36 by welding, fastening means such as a plurality of bolts, etc. Any attaching means which will firmly support the straps when supporting a filled oil barrel can be utilized. Straps 72 and 74 can be formed from metal, reinforced fiber and plastic and the like. The material of construction is not critical to the operation of the invention so long as the material can withstand the loads and environmental conditions under which barrel warming device 10 may be placed.

Figure 3:
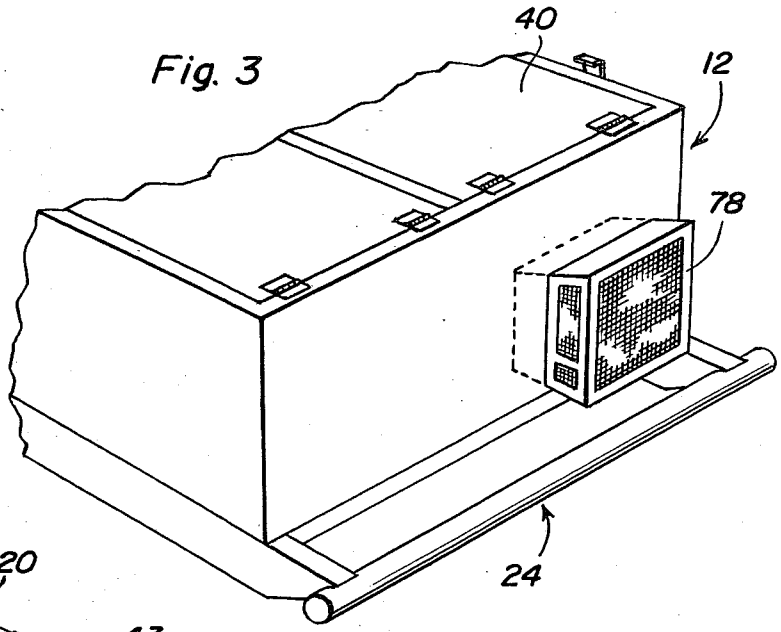
FIG. 3 is an enlarged partial perspective view of the barrel warming device illustrating the placement of a heating means on the hot air inlet of the housing.

Barrel warming device 10 has particular utility in association with oil drilling rigs operating in extremely cold climates. Secured to housing 12 and associated with hot air inlet 76 on housing 12, FIG. 1, is heater 78, shown in FIG. 3 as an electric heating device. Heater 78 can also operate with steam heat, oil, gas, etc. The addition of heated air within housing 12 enables the oil within barrels 14 to keep warm and thus maintain the proper operating viscosity for use in lubricating the oil drilling rigs regardless of the ambient temperature. The temperature maintained in compartments 34 can be controlled by inserting thermostats (not shown) within the housing causing heating device 78 to operate according to need. Any device which can supply hot air to inlet 76 or radiant heat into housing 12 can be utilized in place of the heating device shown.

Barrel warming device 10 of the present invention enables lubricating oil stored in barrels to be maintained at the proper operating viscosity in extreme cold climates and enables the storage of all the barrels on an easily transportable skid which is moved when the drilling rig is moved. This prevents the oil barrels from having to be handled more than one time for transportation to different drilling sites. Further the storage compartments for the individual barrels firmly hold the barrels therein preventing the barrels from being tossed about and possibly damaged. Hoist 52 also reduces the amount of needed manpower to transport barrels 14 as hoist 52 can move the individual barrels to and from the barrel warming device 10. Since device 10 has particular use in extremely cold climates, manual labor can become very harsh, and thus, hoist 52 eases the burden of such labor and can in fact significantly reduce the manpower needed.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A barrel warming device for storing a plurality of oil barrels comprising an enclosed housing adapted to hold in the interior thereof a plurality of oil barrels and placed on a transportable support, the interior of said housing comprising a plurality of individual compartments, each of said compartments capable of supporting a single barrel of oil and including a door which enables the barrels to be moved into and out of said compartments, said device further including means to move said barrels into and out of said compartments, said housing including a heating means for supplying heat to barrels contained within said housing, the surface area of said transportable support being larger than said housing, the space on said support not enclosed by said housing comprising a storage space.

2. The device of claim 1 wherein said means to move said barrels comprises a hoist means, said hoist means capable of rotating 360° and including a holding means for attachment to said barrels.

3. The device of claim 1 wherein said transportable support comprises a skid means.

4. The device of claim 3 wherein said storage space is enclosed by a railing placed on said skid means and by said housing.

5. The device of claim 1 wherein said individual compartments comprise a holding means capable of supporting said barrels when said barrels are laying down.

6. The device of claim 5 wherein said holding means comprises a pair of spaced strap members secured between spaced transverse supports along said housing.

7. The device of claim 1 wherein said storage space contains a screen floor.

8. The device of claim 1 wherein each of said doors are placed on the top of said housing to provide access to the individual compartments.

9. The device of claim 1 wherein said heating means is capable of supplying hot air or radiant heat into the interior of said housing.

10. The device of claim 9 wherein said compartments are formed and separated by transverse supports extending between walls which form the interior of said housing, whereby air is free to flow between compartments.

* * * * *